United States Patent [19]

Klingler

[11] 3,982,343

[45] Sept. 28, 1976

[54] SIMULATED ARTICLE DISPLAY STRUCTURE

[76] Inventor: Josef F. Klingler, 1335 Gregory, Wilmette, Ill. 60091

[22] Filed: June 18, 1975

[21] Appl. No.: 588,069

[52] U.S. Cl. ..... 40/27.5

[51] Int. Cl.[2] ..... G09F 3/02

[58] Field of Search..... 40/27.5, 10 R; 264/246, 264/247, 249; 156/303.1; 428/13, 67; 29/163.5

[56] References Cited

UNITED STATES PATENTS

| | | | |
|---|---|---|---|
| 447,556 | 3/1891 | Beyer | 264/245 |
| 3,312,197 | 4/1967 | Smith | 40/27.5 UX |
| 3,440,128 | 4/1969 | Kubilius | 428/13 X |
| 3,499,808 | 3/1970 | Obeda | 264/249 |

FOREIGN PATENTS OR APPLICATIONS

| | | | |
|---|---|---|---|
| 585,645 | 10/1959 | Canada | 428/3 |

*Primary Examiner*—Louis G. Mancene
*Assistant Examiner*—John H. Wolff
*Attorney, Agent, or Firm*—Wegner, Stellman, McCord, Wiles & Wood

[57] ABSTRACT

A simulated article display structure wherein a representation of an article is provided within a transparent enclosure defined by a formed inner surface provided with a suitable coating. In the illustrated embodiment, the enclosure includes two portions secured together to provide a simulation of a three-dimensional embedded article. In the illustrated embodiment, the article being simulated is a coin and the enclosure is an enclosure similar to conventional coin collector mounts. The simulation of the article may be enhanced by the provision of a weight within the hollow interior of the simulated representation. Simulation of the color ot the article may be enhanced by coloring of the enclosure material.

17 Claims, 6 Drawing Figures

SIMULATED ARTICLE DISPLAY STRUCTURE

BACKGROUND OF THE INVENTION

1. Field of the Invention

This invention relates to display structures and, in particular, to display structures wherein simulated articles are embedded within transparent enclosures.

2. Description of the Prior Art

In conventional numismatic display enclosures wherein coins are mounted to be seen through front and rear surfaces of the enclosure, the enclosures are defined by two flat portions adapted to be secured in mating relationship, with the coin received therebetween so that the obverse side of the coin may be seen through one flat face of the enclosure and the reverse side of the coin may be seen through the opposite flat face of the enclosure.

It is also known to provide imitation coins. However, because of illegality of reproduction of actual coins, such reproduced coins must differ from actual coins so as to not constitute an accurate representation thereof.

SUMMARY OF THE INVENTION

The present invention comprehends the provision of a simulated article display structure which simulates a coin or similar article carried within a transparent enclosure, such as a coin mount enclosure conventionally utilized by numismatists.

The simulated article display structure of the present invention is defined by a pair of complementary enclosure elements having obverse and reverse article configuration formed on the inner surfaces thereof which, upon association of the elements, effectively simulate a three-dimensional article. In the illustrated embodiment, the surfaces of the elements through which the obverse and reverse portions of the simulated article are viewable are flat, it being obvious to those skilled in the art that other suitable configurations may be utilized as desired. Further, in the illustrated embodiment, the enclosure elements define a parallelepiped enclosure, it being obvious to those skilled in the art that any suitable enclosure configuration may be utilized as desired.

The internal formed surface may further define side portions of the simulated article so as to further simulate the three-dimensional configuration thereof.

The configuration of the formed surfaces may be accurately similar to that of actual coins, as the surfaces merely simulate surface appearance of the actual coin and do not in any sense counterfeit an actual coin. More specifically, the display structure of the present invention provides a representation of the article which accurately appears to be the actual article while yet the display structure does not contain the article.

The surface formations within the enclosure may be provided with a coating, which is preferably opaque, to cause the surface to simulate the desired article configuration. Where the article to be simulated is a coin, the coating may be a metallic coating. The coating may be formed of the same material as that of the original article, or may comprise a coating merely having a similar appearance as that of the material of the original article.

To simulate most accurately the original article, the original article may be utilized as a mold for the surface configuration which may be formed in the enclosure element concurrently with a molding of the enclosure element. Thus, illustratively, the enclosure element may be formed of a transparent synthetic resin material such as styrene.

Where the coating material comprises a precious metal, the coating may be vacuum plated as an extremely thin layer, such as one of only several millionths of an inch thickness. To prevent abrasion of the coating, a protective coating may be applied to the inner surface.

Where the article being simulated is of substantial weight, simulation of the article may be enhanced in the display structure by provision of a suitable weight within the hollow space defined by the obverse and reverse surface configurations. To prevent shifting of the weight, the weight may be preselected to fully fill the space, or may be suitably secured in position as by use of a suitable cement or adhesive.

Enhanced simulation of the coloration of the article may be effected by provision of coloring means, such as means tinting the transparent portion of the enclosure overlying the article surfaces. Alternatively, a transparent colored layer may be provided on the enclosure inner surfaces prior to providing the opaque coating.

The enclosure elements may be secured together by any suitable means. In the illustrated embodiment, the elements are secured together by an autogenous sonic weld bond. For facilitated manufacture, orienting elements may be provided on the elements, assuring the securing of the elements in preselected oriented relationship. In the illustrated embodiment, the oriented elements comprise two dissimilar-sized male and female interlocking portions of the elements.

Thus, the display structure of the present invention is extremely simple and economical of construction, while yet providing an improved simulated article display. Where the article to be simulated comprises a real coin, the present invention avoids counterfeiting of the coin while yet provides an accurate simulated representation thereof.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
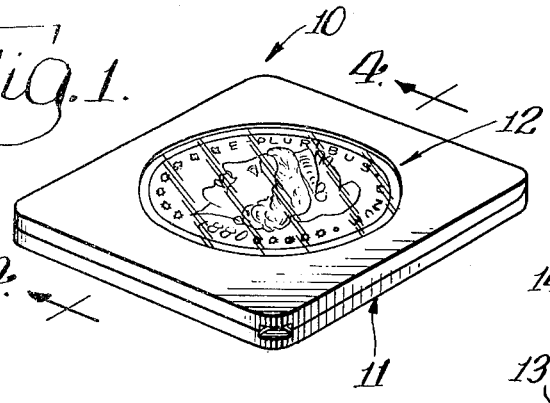
FIG. 1 is a perspective view of a simulated article display structure embodying the invention.

In the exemplary embodiment of the invention as disclosed in the drawing, a simulated article display structure generally designated 10 is shown to comprise an enclosure generally designated 11 having means 12 providing a simulated representation of an article which appears to be embedded within the enclsoure. The enclosure 11 may comprise a pair of enclosure elements 13 and 14 suitably secured together to form the complete enclosure, with the article being simulated appearing to be retained between the enclosure elements as illustrated in FIG. 1.

In actuality, the simulated article is defined in structure 10 by formed surfaces 15 and 16 on the inside of elements 13 and 14, respectively. Surface 15 may be an accurate negative reproduction of the obverse side of an article such as a coin, and surface 16 may be an accurate reproduction of the reverse surface thereof. Molding techniques may be utilized which reproduce such surfaces with extremely high accuracy so as to include surface scratches and other patina-forming deformations, thereby extremely accurately simulating an original coin article.

The enclosure elements may be formed as by molding from a suitable transparent material, such as styrene or the like. Outwardly of the surfaces 15 and 16, the elements may be provided with an inner mat surface 17 for further improved display of the simulated article.

To provide the desired opaque appearance of the article, a coating may be provided on surfaces 15 and 16 as by vacuum plating of a suitable metal where the article to be simulated is a metal article. Thus, where the article comprises a coin, the surfaces 15 and 16 may be vacuum plated with silver, gold, etc., corresponding to the metal of the original coin.

It has been found, however, that highly accurate simulation of the color of silver coins may be obtained by utilizing an aluminum coating in combination with a transparent coloration means. The coloration means may comprise suitable tinting of the enclosure elements, or, alternatively, may comprise the provision of a transparent tinted layer directly on the surfaces 15 and 16 applied prior to the provision of the vacuum plated layer.

Figure 4:
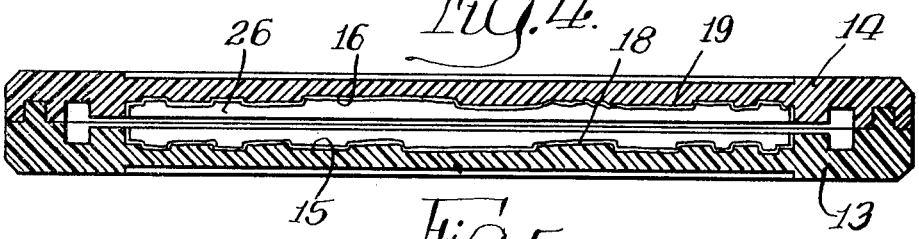
FIG. 4 is a fragmentary enlarged vertical section taken substantially along the line 4—4 of FIG. 1.
Figure 5:
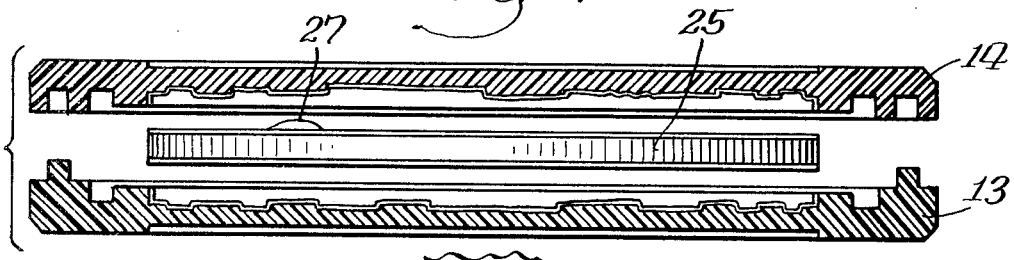
FIG. 5 is a an exploded vertical section similar to that of FIG. 4, but including a weight for enhanced simulation of the article.

The invention broadly comprehends providing a suitable coating on the formed surfaces 15 and 16 to provide the desired simulated appearance of the article. Where the article is a painted article, obviously a similar paint may be provided on surfaces 15 and 16. Other suitable coating materials may be utilized within the scope of the invention.

Where the coating, such as coatings 18 and 19 on surfaces 15 and 16 as shown in FIG. 4, comprises precious metal coatings, the coatings may be provided in extremely thin thicknesses, such as approximately several millionths of an inch. It has been found that such extremely thin coatings are completely opaque and thus provide accurate simulation of the original article. To protect the thin coating against abrasion such as during assembly, a protective coating such as paint coating 20, illustrated in FIG. 6, may be provided on the opaque coating as by being sprayed thereon from a suitable spray device 21.

Figure 3:
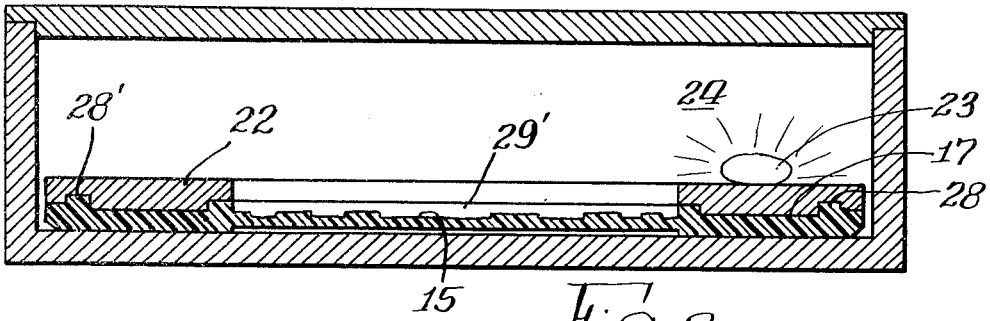
FIG. 3 is a vertical section illustrating the vacuum plating of the article simulating surface of one of the enclosure elements thereof.
Figure 6:
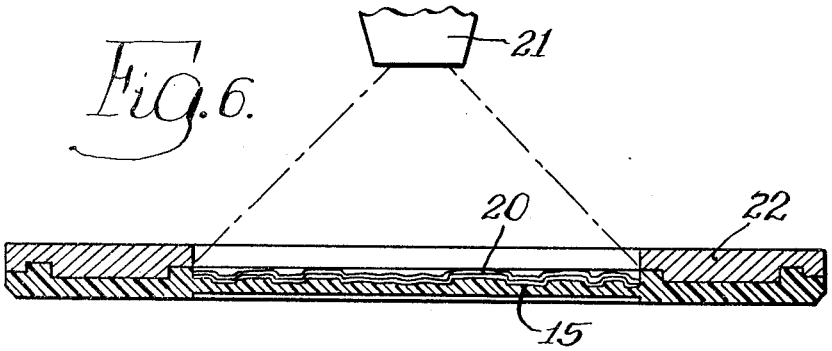
FIG. 6 is a vertical section illustrating the provision of a protective coating on the opaque coating.

As illustrated in FIGS. 3 and 6, the inner surface of the element may be overlaid with a suitable mask 22 for exposing only the desired surface during the vacuum plating operation as shown in FIG. 3 or the spraying operation as shown in FIG. 6. As illustrated in FIG. 3, the vacuum plating operation comprises a conventional vacuum plating step wherein a small mass 23 of the precious metal is provided within vacuum chamber 23 and caused to deposit on the formed plastic surface 15 (or 16) to define the desired opaque metal coating.

As indicated above, to provide enhanced simulation of the article being represented, the weight of the article may be simulated by means of a weight 25 disposed between coated surfaces 15 and 16 prior to the assembly of the enclosure elements 13 and 14. The weight may be secured against movement in the space 26 defined by the article simulating surfaces by suitable means such as cement or adhesive material 27. Illustratively, the securing material may comprise a non-hardening putty. As indicated briefly above, the weight may be physically secured by suitable correlation of its dimension with that of the recess 26.

Figure 2:
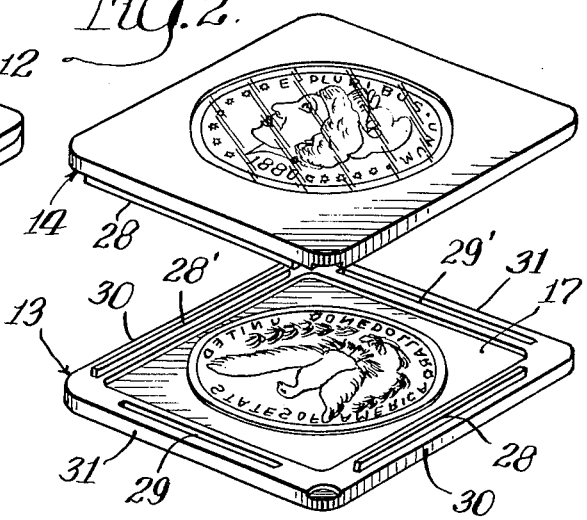
FIG. 2 is an exploded perspective view thereof.

For facilitating the assembly of the enclosure 11, the elements 13 and 14 may be provided with male and female interlocking means such as male ribs 28 and 28' and female slots 29 and 29' provided in pairs on opposite upstanding peripheral flange portions 30 and 31 of the enclosure element. The male and female interlocking means of enclosure 14 may be displaced 90° from those of enclosure element 13 to permit the ready snap assembly of the enclosure 11. As illustrated in FIG. 2, the ribs 28 and 28' may be of different lengths, and the slots 29 and 29' may be of similar different lengths so as to define orienting means assuring that the elements 13 and 14 are assembled in only one position relative to each other, and thus assuring that the simulated reverse surface of the coin is properly positioned relative to the simulated obverse surface.

The enclosure elements may be permanently secured together as desired as by any suitable securing means. In the illustrated embodiment, the elements are secured together by an autogenous bond such as provided by sonic welding of the ribs 28 and 28' in the slots 29 and 29'. While the securing means are illustrated as ribs and slots, as will be obvious to those skilled in the art, any suitable securing means may be utilized, such as pin and cylinder recesses, sonically welded flat surfaces, etc. Where interlocking means are not provided, suitable adhesive, solvent bond, cement and similar securing means may be utilized.

Other suitable examples of materials from which the display structure may be formed are other synthetic resins such as acrylic resins, acrylonitrile resins, etc.

In the illustrated embodiment, enclosure 11 simulates a numismatic coin collector's enclosure. As will be obvious to those skilled in the art, other suitable enclosure configurations may be utilized within the scope of the invention.

The foregoing disclosure of specific embodiments is illustrative of the broad inventive concepts comprehended by the invention.

I claim:

1. A simulated coin display structure comprising: a first enclosure element having a transparent portion provided with an inner surface portion defining a representation of the front configuration of a coin to be displayed through said transparent portion of the first enclosure element; a complementary second enclosure element retained in association with said first enclosure element and having a transparent portion aligned with said first element transparent portion and provided with an inner surface portion defining a representation of the rear configuration of the coin to be displayed through said transparent portion of the second enclosure element, said surface configuration defined by said first and second enclosure element inner surface portions cooperatively comprising a representation of the outer surface of the coin to be displayed; and means for causing the observed color of the representation to correspond to that of the coin being simulated, said display structure having a weight preselected to simulate an actual such coin visually simulated in said enclosure elements.

2. The simulated coin display structure of claim 1 wherein each of said front and rear configurations includes approximately one-half the side surface of the coin configuration.

3. The simulated coin display structure of claim 1 wherein each of said front and rear configurations includes slightly more than one-half the side surface of the coin configuration.

4. The simulated coin display structure of claim 1 wherein cooperating means are provided on said elements for orienting the elements to provide a preselected associated arrangement of the elements.

5. The simulated coin display structure of claim 1 wherein cooperating male and female means are provided on said elements for orienting the elements to provide a preselected associated arrangement of the elements.

6. The simulated coin display structure of claim 1 wherein cooperating different length rib and slot means are provided on said elements for orienting the elements to provide a preselected associated arrangement of the elements.

7. The simulated coin display structure of claim 1 wherein said surface portions are provided with a thin opaque layer.

8. The simulated coin display structure of claim 1 wherein said surface portions are provided with an outer colored transparent layer, and an inner opaque layer.

9. The simulated coin display structure of claim 1 wherein said transparent portions are tinted.

10. The simulated coin display structure of claim 1 wherein said elements are secured together by an autogenous bond.

11. The simulated coin display structure of claim 1 wherein said elements are secured together by an autogenous sonic weld.

12. A simulated coin display structure comprising: a first enclosure element having a transparent portion provided with an inner surface portion defining a representation of the front configuration of a coin to be displayed through said transparent portion of the first enclosure element; a complementary second enclosure element retained in association with said first enclosure element and having a transparent portion aligned with said element transparent portion and provided with an inner surface portion spaced from said inner surface of said first element to define a hollow space therebetween and defining a representation of the rear configuration of the coin to be displayed through said transparent portion of the second enclosure element, said surface configurations defined by said first and second enclosure element inner surface portions cooperatively comprising a representation of the entire outer surface of the coin to be displayed, at least one of said surface portions comprising an inner metal layer different from that of the coin being simulated; coloring means at the associated transparent portion for causing the observed color of the representation to accurately simulate that of the coin being simulated; and weight means in said hollow space preselected to simulate the weight of the coin being simulated.

13. The simulated coin display structure of claim 12 wherein said coloring means comprises means for tinting said transparent portion.

14. The simulated article display structure of claim 12 wherein said coloring means comprises a layer of light-transmitting material on said inner surfaces.

15. A simulated coin display structure comprising: a first enclosure element having a transparent portion provided with and inner surface portion defining a representation of the front configuration of a coin to be displayed through said transparent portion of the first enclosure element; a complementary second enclosure element retained in association with said first enclosure element and having a transparent portion aligned with said first enclosure element transparent portion and provided with an inner surface portion defining a representation of the rear configuration of the coin to be displayed through said transparent portion of the second enclosure element, said surface configurations defined by said first and second enclosure element inner surface portions cooperatively comprising a representation of the entire outer surface of the coin to be displayed; and a multilayer coating on said surface portions including an outer metal layer and an inner protective layer, said display structure having a weight preselected to simulate an actual such coin visually similated in said enclosure elements.

16. The simulated coin display structure of claim 15 wherein said inner layer comprises paint.

17. The simulated coin display structure of claim 15 wherein said coating includes a transparent colored layer outwardly of said metal layer.

* * * * *